US006203888B1

(12) United States Patent
Aoki

(10) Patent No.: US 6,203,888 B1
(45) **Date of Patent: *Mar. 20, 2001**

(54) INK-JET PRINTING CLOTH, INK-JET PRINTING PROCESS AND PRINT

(75) Inventor: Makoto Aoki, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/797,710

(22) Filed: Feb. 11, 1997

(30) Foreign Application Priority Data

Feb. 15, 1996 (JP) ..... 8-028242
Feb. 5, 1997 (JP) ..... 9-022581

(51) Int. Cl.[7] ..... B41M 5/00; B41J 2/01

(52) U.S. Cl. ..... 428/195; 347/105; 442/76; 442/152

(58) Field of Search ..... 347/105, 106; 428/195, 411.1; 442/152, 76

(56) References Cited

U.S. PATENT DOCUMENTS

| | | | | |
|---|---|---|---|---|
| 5,468,553 | | 11/1995 | Koike et al. | 428/224 |
| 5,494,733 | | 2/1996 | Koike et al. | 428/224 |
| 5,594,485 | | 1/1997 | Koike et al. | 347/101 |
| 5,635,970 | * | 6/1997 | Shirota et al. | 347/106 |
| 5,645,631 | * | 7/1997 | Koike et al. | 106/31.36 |

FOREIGN PATENT DOCUMENTS

| | | |
|---|---|---|
| 553761A1 | 8/1993 | (EP) . |
| 652320A1 | 5/1995 | (EP) . |
| 666362A2 | 8/1995 | (EP) . |
| 693587A2 | 1/1996 | (EP) . |
| 63-31593 | 6/1988 | (JP) . |
| 63-31594 | 6/1988 | (JP) . |
| 4-59282 | 2/1992 | (JP) . |
| 5-212851 | 8/1993 | (JP) . |
| 8-3884 | 1/1996 | (JP) . |

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is an ink-jet printing cloth comprising at least two water-soluble neutral salts in a proportion of 0.1 to 30% by weight.

13 Claims, 4 Drawing Sheets

1000
1010
1012
1020
1022
1030
1032
1100
1110,1120
100
110
120
130
140
140
150
15
13
11
1
17
19
21
600
1B
f
133
1
130

INK-JET PRINTING CLOTH, INK-JET PRINTING PROCESS AND PRINT

BACKGROUND OF THE INVENTION

1. Field of the Invention

The present invention relates to an ink-jet printing cloth, an ink-jet printing process and a print obtained by the ink-jet printing process.

2. Related Background Art

Besides screen printing and roller printing, ink-jet printing has heretofore been known as a process of printing on cloth formed of cotton, silk, polyester or the like. This ink-jet printing is conducted by means of an ink-jet printing apparatus obtained by improving an image-forming apparatus of an ink-jet system for forming images on recording media such as plastics and recording paper so as to be fitted for textile printing and the kind of cloth to be used.

The ink-jet system is a non-impact printing system, which ejects an ink or the like to directly apply the ink to cloth or the like and produces little noise. A textile printing apparatus equipped with an ink-jet system printing head permits high-density printing operation at high speed. The textile printing processes using a plate such as a screen or a design roller are unfit for multi-kind small-quantity production, whereas the ink-jet textile printing process is a system making no use of any plate, and is fit for multi-kind small-quantity production and can perform textile printing in a short period of time because data for printing can be formed with ease by a host system or the like.

The textile printing apparatus of the ink-jet system is generally equipped with a printing means (printing head) mounted on a carriage, a feeding means for feeding a cloth and a control means for controlling these means. The printing head by which ink droplets are ejected through a plurality of ejection orifices serially scans in a conveying direction (a secondary scanning direction) of the cloth and a direction perpendicular to it (a main scanning direction), while the cloth is intermittently fed by a predetermined length at the time printing is stopped. According to this printing process, inks are ejected on the cloth according to printing signals to conduct printing. Therefore, the ink-jet printing process attracts attention as a printing method which is low in running cost and silent. When a printing head in which a plurality of ink-ejecting nozzles has been aligned in the secondary scanning direction is used, printing of a width corresponding to the number of the nozzles can be performed every time the printing head scans once on the cloth.

In the case of multi-color textile printing (color printing), a color image is formed by overlapping ink droplets of plural colors ejected from respective printing heads. In general, color printing requires three or four printing heads and ink tanks corresponding to three primary colors of yellow (Y), magenta (M) and cyan (C) or four colors including black (B) in addition to these primary colors.

Since such devices are used, the techniques required of ink-jet printing are greatly different from those of screen and roller printing. More specifically, this is caused by such differences in the systems that since the optimum value of viscosity of inks used in ink-jet printing is far lower than that of inks used in screen printing or roller printing, a large amount of inks cannot be applied at once from the viewpoint of occurrence of bleeding, that strike-through of the resulting print becomes poor due to this application of the inks in the small amount, that the ink-jet printing requires attention to reliability such as clogging of the head, that the so-called additive color process, in which a few inks of different colors are shot on the same position so as to overlap each other, is conducted, and that the dots of inks are very small.

Various investigations have thus been attempted as to methods of such ink-jet printing. For example, Japanese Patent Publication No. 63-31594 discloses a method in which textile printing is conducted on a cloth containing a water-soluble polymer, a water-soluble salt and water-insoluble inorganic fine particles, and Japanese Patent Publication No. 63-31593 discloses a textile printing method in which inks each having a viscosity of 200 cP or lower and a surface tension of 30 to 70 dyn/cm, and a cloth having a water repellency of 50 marks or more as measured in accordance with JIS L 1079 are used.

Since the prior art printing methods described above are based on thinking that the penetration of inks into the interior of fiber is prevented to prevent the diffusion of dyes, an improvement in coloring ability is recognized to some extent. However, they involve problems such as (1) it takes a long time to dry the inks, (2) no strike-through occurs because the inks do not spread, and (3) an area factor becomes small because the inks do not spread, and so coloring ability is limited.

On the other hand, for example, Japanese Patent Application Laid-Open No. 4-59282 discloses an ink-jet printing cloth obtained by incorporating 0.1 to 3% by weight of a surfactant into a cloth formed of a hydrophilic fiber material. According to the cloth subjected to such a treatment, inks are absorbed in the interior of the fiber by diffusion, and so the tendency to strike-through is enhanced. However, such a cloth is unfavorable with respect to improvement in coloring ability because dyes penetrate into the interior of the fiber.

As described above, the prior art techniques have been able to satisfy individual performance characteristics required of the ink-jet printing process for obtaining excellent prints to some extent, but have been unable to satisfy the various performance characteristics at the same time.

SUMMARY OF THE INVENTION

It is therefore an object of the present invention to provide an ink-jet printing cloth, which can provide bright prints excellent in drying property, free of bleeding, high in color depth, image quality and grade, and good in tendency to strike-through.

The above object can be achieved by the present invention described below.

According to the present invention, there is thus provided an ink-jet printing cloth comprising at least two water-soluble neutral salts in a proportion of 0.1 to 30% by weight.

According to the present invention, there is also provided an ink-jet printing process comprising ejecting inks from an ink-jet printing apparatus to print a cloth, wherein the cloth described above is used as said cloth.

According to the present invention, there is further provided a print produced in accordance with the ink-jet printing process described above.

DESCRIPTION OF THE PREFERRED EMBODIMENTS

Figures 1A, 1B:
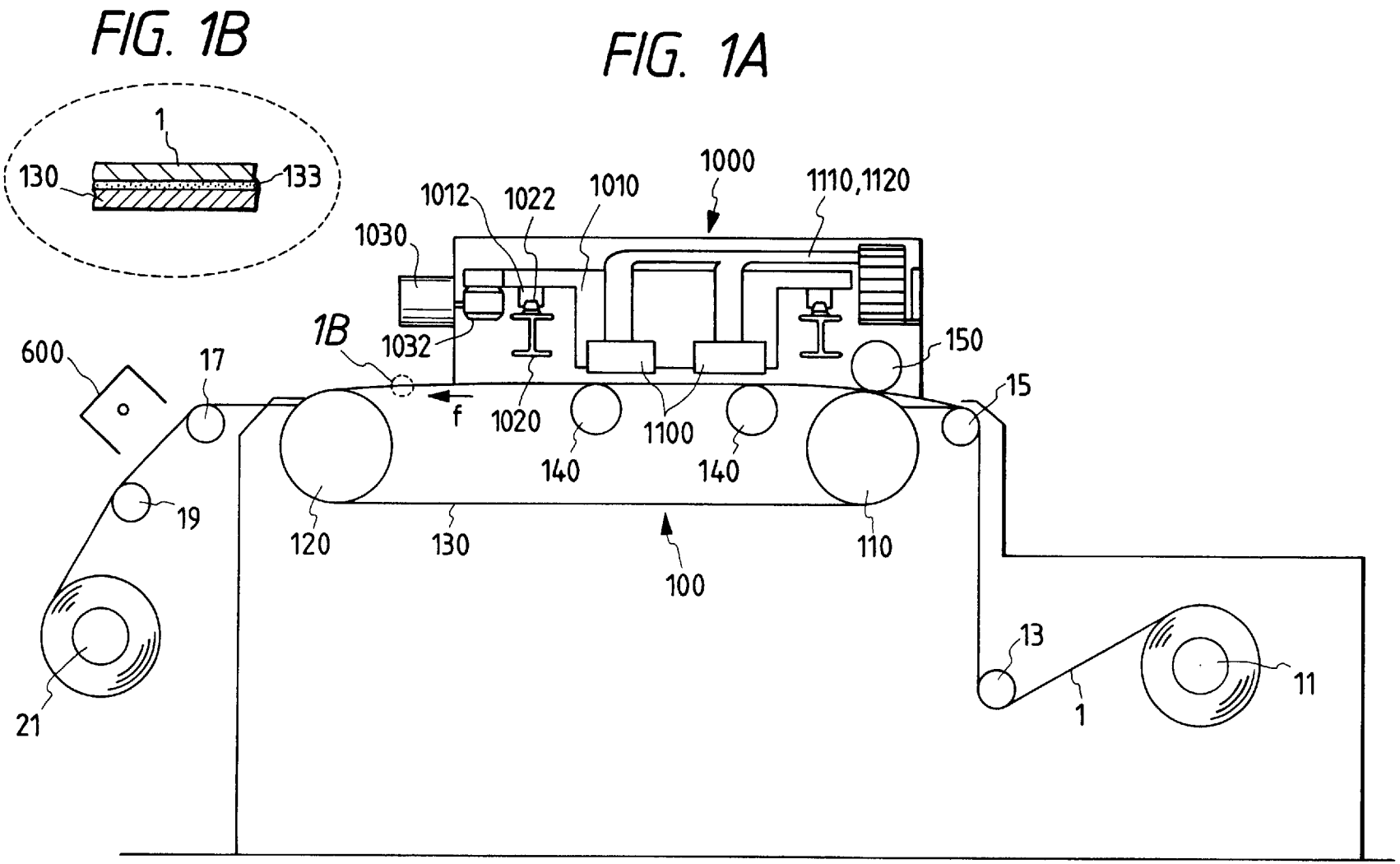
FIG. 1A is a typical sectional side elevation schematically illustrating the construction of an ink-jet printing apparatus to which the present invention is applied.
FIG. 1B is an enlarged view of a portion of a conveyor belt in FIG. 1A.

No particular limitation is imposed on a fiber material for the ink-jet printing cloth according to the present invention. Examples thereof include various fiber materials such as cotton, silk, wool, nylon, polyester, rayon and acrylic fibers. The cloth used may be a blended fabric or union cloth thereof.

The present invention is particularly effective when, above all, silk is used as the fiber material, and in this case bleeding can be effectively prevented, color yield can be enhanced, and color depth can be improved.

In the present invention, at least two water-soluble neutral salts are incorporated into a cloth. The term "water-soluble neutral salt" as used herein means a salt exhibiting neutrality when dissolved in water. Such a salt is a low molecular weight salt having a molecular weight of preferably 1,000 or lower, more preferably 500 or lower.

As cations of the water-soluble neutral salts, Na, K, Ca, Li and Mg are preferred, with Na being particularly preferred.

As anions of the water-soluble neutral salts, F, Cl, Br, I, $SO_4$, $NO_3$, $ClO_3$, SCN and $CH_3COO$ are preferred, with $SO_4$ and Cl being particularly preferred.

Specific examples of the water-soluble neutral salts include NaCl, $Na_2SO_4$, KCl, $CaCl_2$ and $MgCl_2$, with $Na_2SO_4$ and NaCl being particularly preferred.

Said at least two water-soluble neutral salts incorporated into the cloth are preferably composed of a salt A in which its anion has salting-out ability greater than that of $CH_3COO^-$ and a salt B in which its anion has salting-out ability equal to or smaller than that of $CH_3COO^-$.

The term "salting-out ability" as used herein means lyotropic series in accordance with the following definition:

citric acid>succinic acid>$SO_4$>$CH_3COOH$>Cl>Br>$ClO_3$>I>SCN.

The effects of the salt A and the salt B will now be described. The salt A is dissolved in an ink at the time the ink has been impacted on the cloth. By the dissolution of the salt A, a water-soluble dye dissolved or a dispersing agent by which water-insoluble dye is dispersed in the ink is salted out. Therefore, the ink is aggregated, so that ink bleeding in fiber is prevented.

On the other hand, the salt B has an effect of enhancing the color depth of the resulting print by similarly dissolving in the ink impacted on the cloth. The details thereof are not yet known, but considered to be due to the fact that electrostatic force is enhanced by the dissolution of the electrolyte in the ink, so that the affinity of the dye in the ink for the fiber is increased. Namely, the dye is made liable to be fitted for the fiber by the salt B, and color yield is hence increased, whereby the color depth is enhanced.

It is particularly preferred to use a combination of salts A and B in which the salt A is $Na_2SO_4$ and the salt B is NaCl.

The weight ratio of the salt A to the salt B to be contained desirably satisfies the relationship of the expression:

0.2<(content of salt A/content of salt B)<5, more preferably 0.3<(content of salt A/content of salt B)<3.

If the weight ratio of the content of salt A to the content of salt B is not higher than 0.2, the effect of preventing bleed tends to be lowered because the proportion of the salt great in salting-out ability is too low. If the weight ratio thereof is not lower than 5 on the other hand, the tendency of the resulting printing cloth to strike through inks is deteriorated because the proportion of the salt great in salting-out ability is too high, and it may be difficult in some cases to manifest the effect of the salt having small salting-out ability for enhancing the color depth.

The total amount of the salt A and the salt B to be incorporated in the cloth is preferably from 0.1 to 30% by weight, more preferably from 1 to 10% by weight. If the total amount to be incorporated is less than 0.1% by weight, the resulting printing cloth has a tendency to be hard to sufficiently achieve the effects of preventing bleed and enhancing the color depth. On the other hand, any total amount exceeding 30% by weight results in a printing cloth showing a tendency to lower the color yield.

In a preferred embodiment of the present invention, it is desirable that the cloth further contains a water-soluble polymer in addition to the salt A and the salt B. Examples of the water-soluble polymer include various kinds of starch, cellulosic substances such as carboxymethyl cellulose, methyl cellulose and hydroxyethyl cellulose, sodium alginate, gum arabic, guar gum, gelatin, tannin and derivatives thereof, polyvinyl alcohol and derivatives thereof, polyethylene oxide and derivatives thereof, water-soluble acrylic polymers, and water-soluble maleic anhydride polymers.

Of these, polyethylene oxide is particularly preferred from the view point that bleed can be effectively prevented. The polyethylene oxide preferably has a weight average molecular weight of from 100,000 to 4,000,000, more preferably from 500,000 to 2,500,000 from the viewpoint of viscosity and the like.

The content of the water-soluble polymer is preferably 0.1 to 30% by weight, more preferably 0.2 to 5% by weight based on the cloth. Any amount of the water-soluble polymer exceeding 30% by weight results in a cloth markedly deteriorated in desizing ability. It is also not preferred from the viewpoint of economy to contain the water-soluble polymer in such a great amount. On the other hand, if the content is lower than 0.1% by weight, the effect of such an agent is not sufficiently exhibited.

In the present invention, it is preferable that the cloth further contains an alkaline substance in addition to the salt A, the salt B and the water-soluble polymer.

In the present invention, the alkaline substance is preferably a salt of a weak acid with a strong base. Preferable examples of the alkaline substance may include $NaHCO_3$, $Na_2CO_3$, potassium hydroxide, sodium hydroxide, potassium carbonate and potassium hydrogencarbonate.

The content of the alkaline substance is preferably 0.1 to 10% by weight, more preferably 0.5 to 5% by weight based on the cloth. The addition of the alkaline substance brings an effect that in textile printing with inks using reactive dyes, the inks escape containing any alkaline substance therein.

The cloth according to the present invention may also contain other compounds than the above compounds, which are routinely added in conventional printing cloths.

Examples of the compounds usable include urea, catalysts, antireductants, antioxidants, level dyeing agents, deep dyeing agents, carriers, reducing agents, oxidizing agents and metal ions.

Urea is also very effective in prevention of bleed and improvement of a coloring ability. In particular, its combined use with a water-soluble salt has a synergistic effect and is hence preferred.

As a method for incorporating the above-described substances into the cloth, any method such as padding, spraying, dipping, printing or ink-jet may be used.

After conducting such treatment as described above, the thus-treated cloth is finally dried and optionally cut into sizes feedable into an ink-jet printing apparatus, thereby providing these cut pieces as ink-jet printing cloths.

No particular limitation is imposed on inks used for the ink-jet printing cloths according to the present invention. However, when the cloth is formed of a material such as cotton or silk, inks composed of a reactive dye and an aqueous medium are preferably used. When the cloth is formed of a material such as nylon, wool, silk or rayon, inks composed of an acid or direct dye and an aqueous medium are preferably used. When the cloth is formed of a polyester material, inks composed of a disperse dye and an aqueous medium are preferably used.

As specific preferable examples of these dyes, may be mentioned the following dyes. The reactive dyes include C.I. Reactive Yellow 2, 15, 37, 42, 76, 95, 168 and 175; C.I. Reactive Red 21, 22, 24, 33, 45, 111, 112, 114, 180, 218, 226, 228 and 235; C.I. Reactive Blue 15, 19, 21, 38, 49, 72, 77, 176, 203, 220, 230 and 235; C.I. Reactive Orange 5, 12, 13, 35 and 95; C.I. Reactive Brown 7, 11, 33, 37 and 46; C.I. Reactive Green 8 and 19; C.I. Reactive Violet 2, 6 and 22; C.I. Reactive Black 5, 8, 31 and 39; and the like.

The acid and direct dyes include C.I. Acid Yellow 1, 7, 11, 17, 23, 25, 36, 38, 49, 72, 110 and 127; C.I. Acid Red 1, 27, 35, 37, 57, 114, 138, 254, 257 and 274; C.I. Acid Blue 7, 9, 62, 83, 90, 112 and 185; C.I. Acid Black 26, 107, 109 and 155; C.I. Acid Orange 56, 67 and 149; C.I. Direct Yellow 12, 44, 50, 86, 106 and 142; C.I. Direct Red 79 and 80; C.I. Direct Blue 86, 106, 189 and 199; C.I. Direct Black 17, 19, 22, 51, 154, 168 and 173; C.I. Direct Orange 26 and 39; and the like.

The disperse dyes include C.I. Disperse Yellow 3, 5, 7, 33, 42, 60, 64, 79, 104, 160, 163 and 237; C.I. Disperse Red 1, 60, 135, 145, 146 and 191; C.I. Disperse Blue 56, 60, 73, 143, 158, 198, 354, 365 and 366; C.I. Disperse Black 1 and 10; C.I. Disperse Orange 30 and 73; Teraprint Red 3GN Liquid and Teraprint Black 2R; and the like.

The amount (in terms of solids) of these dyes to be used is preferably within a range of from 1 to 30% by weight, more preferably from 1 to 20% by weight based on the total weight of the ink.

As the aqueous medium used together with the dyes, there may be used any aqueous medium generally used in inks. Preferable examples thereof include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; polyalkylene glycols such as polyethylene glycol and polypropylene glycol and products obtained by modifying one or two hydroxyl groups thereof, typified by mono- or dialkyl ethers thereof; glycerol; thiodiethylene glycol; sulfolane; N-methyl-2-pyrrolidone; 2-pyrrolidone; and 1,3-dimethyl-2-imidazolidinone. The preferable content of these aqueous media is preferably within a range of generally from 0 to 50% by weight, more preferably from 0 to 30% by weight based on the total weight of the ink.

In the case of a water-based ink, the content of water as a principal component is preferably within a range of from 30 to 95% by weight, more preferably from 50 to 95% by weight based on the total weight of the ink.

Besides the above components, anti-clogging agents such as urea and derivatives thereof, dispersants, surfactants, viscosity modifiers such as polyvinyl alcohol, cellulosic compounds and sodium alginate, pH adjustors, optical whitening agents, mildewproofing agents, and the like may be added as other ingredients for inks as needed.

As an ink-jet recording method and apparatus used, there may be used any method and apparatus conventionally known. Examples thereof include a method and an apparatus in which thermal energy corresponding to recording signals is applied to an ink within a recording head, and ink droplets are generated by this thermal energy.

The inks applied onto the ink-jet printing cloth of the present invention in accordance with the process of the present invention in the above-described manner is only attached to the cloth in this state. Accordingly, it is preferable to subsequently subject the cloth to a process for fixing the dyes in the inks to fiber and a process for removing unfixed dyes. Such a fixing process may be conducted in accordance with any conventionally-known method. Examples thereof include a steaming process, an HT steaming process and a thermofix process. The removal of the unreacted dyes may be performed by any washing process conventionally known.

After conducting the ink-jet printing and the post-treatment of the cloth in the above-described manner, the cloth is dried to provide a print according to the present invention.

An exemplary construction of an ink-jet printing apparatus used in the present invention will hereinafter be roughly described. It goes without saying that the apparatus to which the present invention can be applied is not limited to the construction as described below. It is therefore possible to make any change in construction and add any structural element, which are easily conceived by those skilled in the art.

FIG. 1A is a typical sectional side elevation schematically illustrating the construction of a printing apparatus. Reference numeral 1 designates a cloth as a printing medium. The cloth 1 is unwound according to the rotation of a rewind roller 11, fed in a substantially horizontal direction by a conveyance section 100, which is provided at a position opposite to a printer section 1000, through intermediate rollers 13 and 15, and then wound up on a take-up roller 21 through a feed roller 17 and an intermediate roller 19.

The conveyance section 100 roughly includes conveyance rollers 110 and 120 respectively provided on the upstream and downstream sides of the printer section 1000 viewing from the feeding direction of the cloth 1, a conveyor belt 130 in the form of an endless belt, which is extended between and around these rollers, and a pair of platen rollers 140 provided so as to extend the conveyor belt 130 under an appropriate tension in a predetermined range to enhance its evenness, thereby evenly regulating the surface of the cloth 1 to be printed upon printing by the printer section 1000. In the illustrated apparatus, the conveyor belt 130 is made of a metal as disclosed in Japanese Patent Application Laid-Open No. 5-212851. As illustrated in FIG. 1B with partial enlargement, an adhesive layer (sheet) 133 is provided on its surface. The cloth 1 is adhered to the conveyor belt 130 through the adhesive layer 133 by an attaching roller 150, thereby ensuring the evenness of the cloth 1 upon printing.

To the cloth 1, fed in a state such that the evenness has been ensured as described above, is applied a printing agent in the region between the platen rollers 140 by the printer section 1000. The thus-printed cloth 1 is separated from the conveyor belt 130, or the adhesive layer 133 at the position of the conveyance roller 120 and wound up on the take-up roller 21. In the course of the winding, the cloth 1 is subjected to a drying treatment by a drying heater 600. In particular, this drying heater 600 is effective when a liquid agent is used as the printing agent. The form of the drying heater 600 may be suitably selected from a heater by which hot air is blown on the cloth 1, a heater by which infrared rays are applied to the cloth 1, and the like.

Figure 2:
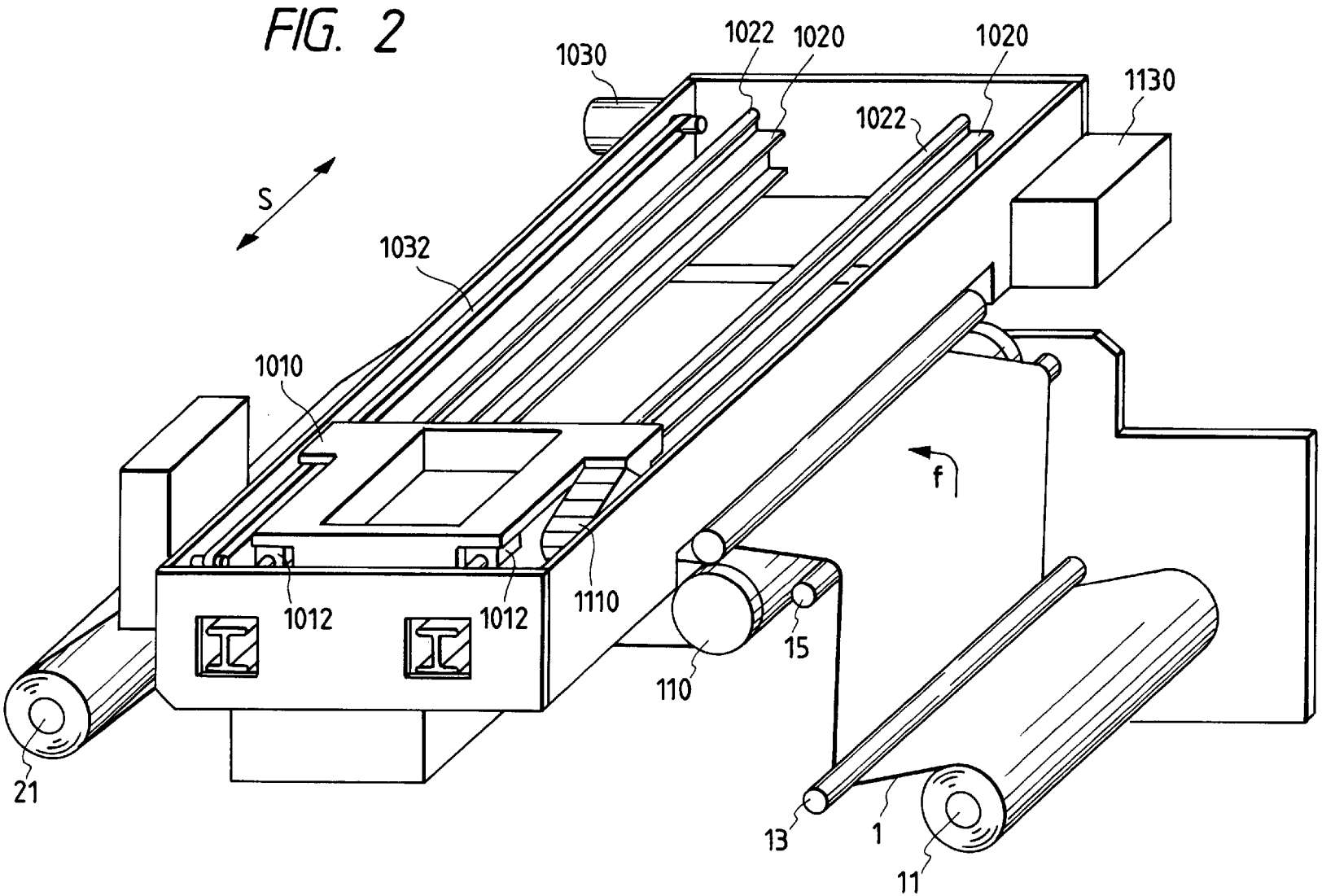
FIG. 2 is a perspective view typically illustrating a printer section and a conveyance section in the apparatus shown in FIG. 1A.

FIG. 2 is a perspective view typically illustrating the printer section 1000 and the feed system of the cloth 1. The construction of the printer section 1000 will be described with reference to this drawing and FIG. 1A.

In FIGS. 1A and 2, the printer section 1000 includes a carriage 1010 which scans in a direction different from the conveying direction (a secondary scanning direction) f of the cloth 1, for example, the width direction S of the cloth 1 perpendicular to the conveying direction f. Reference numeral 1020 designates a support rail extending in the S direction (a main scanning direction) and supporting a slide rail 1022 which supports and guides a slider 1012 fixed to the carriage 1010. Reference numeral 1030 indicates a motor as a drive source for conducting the main scanning of the carriage 1010. The driving power thereof is transmitted to the carriage 1010 through a belt 1032 to which the carriage 1010 has been fixed, or another suitable drive mechanism.

On the carriage 1010, are mounted sets of printing heads 1100 each having many printing agent-applying elements arranged in a predetermined direction (in this case, the conveying direction f), said sets each being composed of a plurality of the printing heads 1100 arranged in a direction (in this case, the main scanning direction S) different from said predetermined direction. In this embodiment, two sets of the printing heads 1100 are held in the conveying direction. In each set, the printing heads 1100 are provided in a number corresponding to the number of printing agents of different colors, thereby permitting color printing. Colors of the printing agents and the number of the printing heads in each set may be suitably selected according to an image intended to be formed on the cloth 1, and the like. For example, yellow (Y), magenta (M) and cyan (C), or the three primary colors for printing, or black (Bk) in addition to these colors may make one set. Alternatively, special colors (metallic colors such as gold and silver, and bright red, blue, etc.), which are impossible or difficult to be expressed by the three primary colors, may be used in place of or in addition to the above color set. Further, a plurality of printing agents may be used according to their color depth even if they have the same colors as each other.

In this embodiment, as illustrated in FIG. 1A, two sets of the printing heads 1100, which each are composed of plural printing heads arranged in the main scanning direction S, are provided one by one in the conveying direction f. The colors, arranging number, arranging order and the like of the printing agents used in the printing heads in the respective sets may be the same or different from each other according to the image intended to be printed, and the like. Further, printing may be made again by the printing heads of the second set on a region printed by main scanning of the printing heads of the first set (either complementary thinning-out printing or overlap printing may be conducted by the respective sets of the printing heads). Furthermore, a printing region may be allotted to each set to perform high-speed printing. Besides, the number of sets of the printing heads is not limited to two and may also be defined as one or more than two.

In these drawings, ink-jet heads, for example, bubble jet heads proposed by Canon Inc., each having a heating element which generates thermal energy causing film boiling of ink as energy used for ejecting the ink, are used as the printing heads 1100. Each of the printing heads is used in a state that ink ejection orifices as the printing agent-applying elements have been disposed downward toward the cloth 1 substantially horizontally conveyed by the conveyance section 100, thereby ironing out the difference in water head between the individual ejection orifices and hence making ejection conditions uniform to permit both formation of good images and even purging operation for all the ejection orifices.

A flexible cable 1110 is connected to each of the printing heads 1100 in such a manner that it follows the movement of the carriage 1010, so that various signals such as drive signals and state signals for the head are transferred between the head and control means not illustrated. Inks are fed from an ink-feeding system 1130, in which respective inks of different colors are contained, to the printing heads 1100 through flexible tubes 1120.

Figure 3:
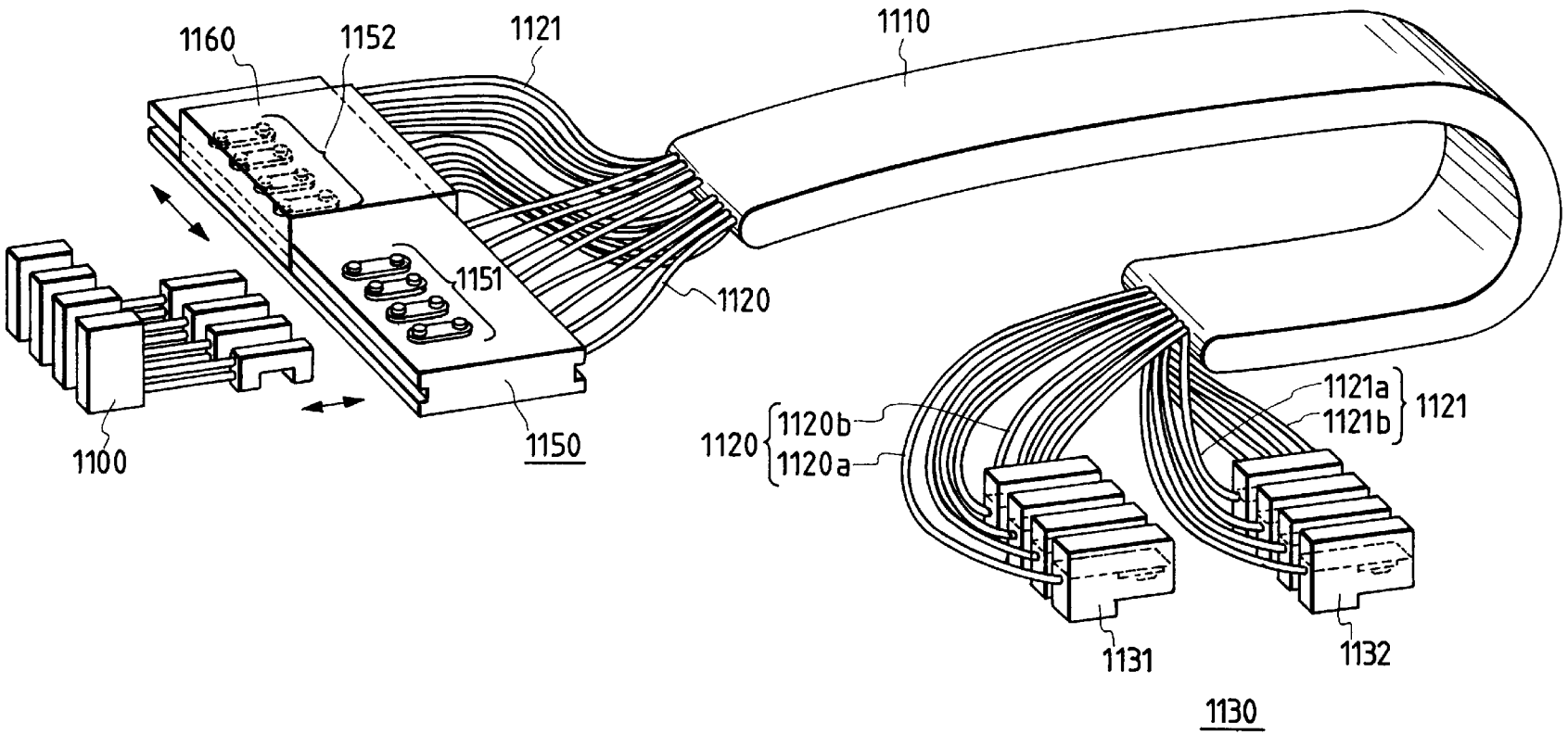
FIG. 3 is a typical perspective view of an ink-feeding system in the apparatus shown in FIG. 1A.

FIG. 3 is a perspective view typically illustrating the ink-feeding system in this embodiment. The ink-feeding system 1130 is composed of two lines. More specifically, in the first line, first ink-feeding tubes 1120 respectively connected to the first set of ink-storage tanks 1131 are connected to a head joint 1150 through the flexible tube 1110. In the second line, similarly, second ink-feeding tubes 1121 respectively connected to the second set of ink-storage tanks 1132 are connected to the head joint 1150 through the flexible tube 1110.

Each ink-feeding tube 1120 or 1121 forms a circulation path composed of an outward ink-feeding tube 1120*a* or 1121*a* and an inward ink-feeding tube 1120*b* or 1121*b*.

The ink-storage tanks 1131 and 1132 each have a pressure pump (not illustrated). The ink in the tank 1131 or 1132 is pressurized by this pressure pump so as to pass through the outward ink-feeding tube 1120*a* or 1121*a* as illustrated in FIG. 3, circulate through the printing head 1100 and then pass through the inward ink-feeding tube 1120*b* or 1121*b*, thereby returning to the ink-storage tank 1131 or 1132.

By this pressure pump, it is possible to recharge the inks into the ink-feeding tubes 1120 and 1121 and also to conduct a purging operation of the head by circulating the ink through the head and discharging a fraction of this ink out of nozzles in the head. The ink-storage tanks 1131 and 1132 may be provided respectively by a number corresponding to the number of the printing agents of different colors, thereby permitting color printing.

The number of the ink-storage tanks in each set may be suitably selected according to an image intended to be formed on the cloth 1, and the like. For example, three tanks for yellow (Y), magenta (M) and cyan (C) colors, or the three primary colors for printing, or four tanks with a tank for a black (Bk) color added to these tanks may be provided. Alternatively, tanks for special colors (metallic colors such as gold and silver, and bright red, blue, etc.), which are impossible or difficult to be expressed by the three primary colors, may be used in place of or in addition to the above tanks. Further, a plurality of tanks may be used according to the color depth even if printing agents used have the same colors as each other.

The head joint 1150 is composed of a head joint 1151 for the first set indicated by a full line, a head joint 1152 for the second set indicated by a broken line and a joint cover 1160 as illustrated in FIG. 3.

The construction of the head used in the above-described apparatus will hereinafter be described schematically with reference to FIG. 4.

Figure 4:
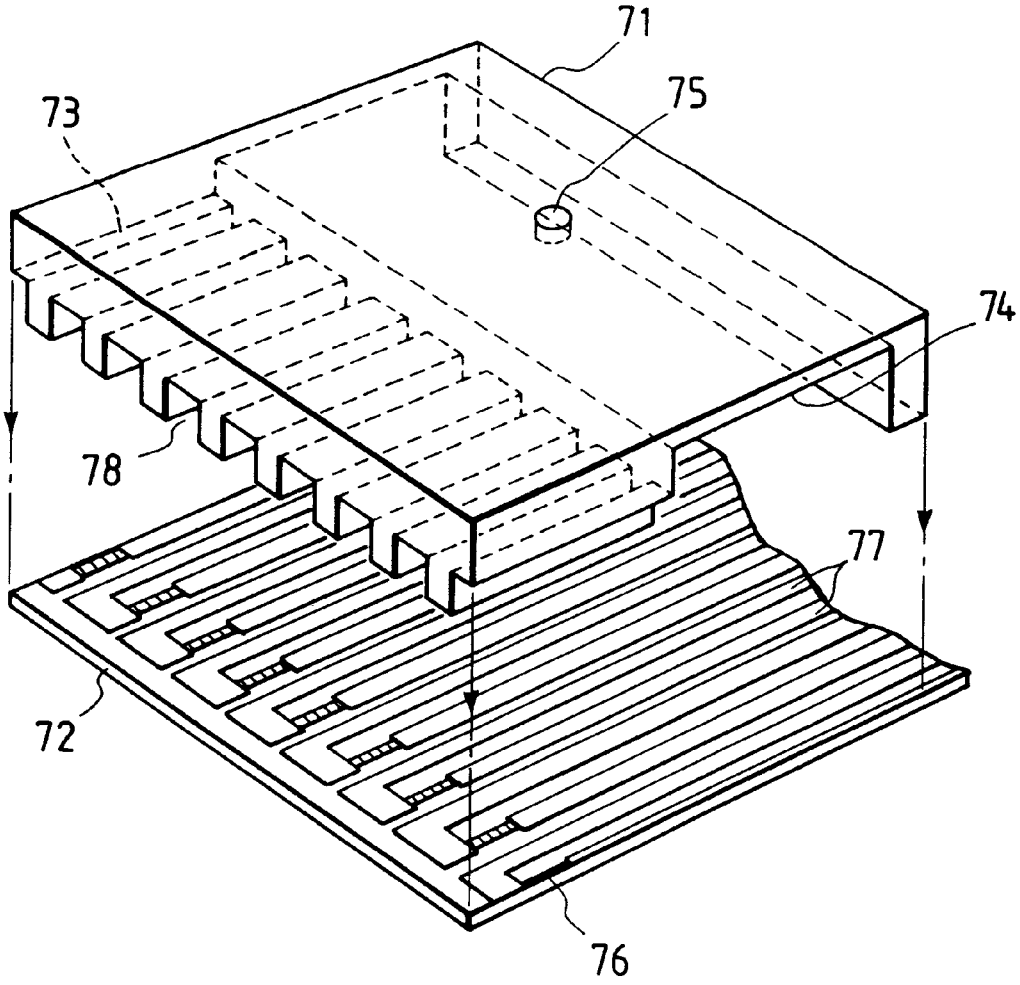
FIG. 4 is a perspective view schematically illustrating the construction of a printing head to be mounted on the apparatus shown in FIG. 1A.

FIG. 4 is a sectional perspective view schematically illustrating the construction of an ink-jet head to be mounted on the ink-jet printing apparatus used in the present invention.

In this drawing, the printing head is constructed by overlapping a top plate 71 and a base plate 72. The top plate 71 has a plurality of grooves 73, which are to define nozzles passing an ink therethrough, a groove 74, which is to define a common liquid chamber communicating with these grooves, and a feed opening 75 for feeding the ink to the common liquid chamber. On the other hand, the base plate 72 includes electrothermal converters 76 corresponding to the individual nozzles and electrodes 77 for supplying electric power to the electrothermal converters 76, respectively, said electrothermal converters 76 and electrodes 77 being formed integrally by a film-forming technique. Plural ejection openings (orifices) 78 through which the ink is ejected are defined by overlapping the top plate 71 and the base plate 72 as described above.

Here, the process of forming ink droplets by the bubble jet system, which is carried out by the above-described printing head, will be described simply.

When a heating resistor (heater) reaches a predetermined temperature, such a filmy bubble as covers a heater surface is first formed. The internal pressure of this bubble is very high, and so an ink within a nozzle is forced out. The ink is moved toward the outside of the nozzle and the interior of the common liquid chamber, which is situated in an opposite direction to the nozzle, by inertia by this forcing out. When the movement of the ink is facilitated, the moving speed of the ink within the nozzle becomes slow because the internal of the bubble turns negative pressure, and flow path resistance also arises in addition. Since the ink portion ejected out of the ejection opening (orifice) is faster in moving speed than the ink within the nozzle, it is constricted by the balance among inertia, flow path resistance, shrinkage of the bubble and surface tension of the ink, whereby the ink portion is separated into a droplet. At the same time as the shrinkage of the bubble, the ink is fed to the nozzle from the common liquid chamber by capillary force to wait for the next pulse.

As described above, the printing head (hereinafter may be referred to as an ink-jet head), in which the electrothermal converter is used as an energy-generating means (hereinafter may be referred to as an energy-generating element), can generate a bubble in the ink within the flow path in one-to-one correspondence in accordance with a driving electrical pulse signal and also immediately and appropriately cause the growth/shrinkage of the bubble, and so the ejection of ink droplets can be achieved with excellent responsiveness in particular. The printing head is advantageous in that it can also be made compact with ease, merits of IC techniques and macro processing techniques in the recent semiconductor field, which are remarkable for advances in technique and enhancement in reliability, can be fully applied thereto, high-density mounting can be achieved with ease, and production costs are also low.

The present invention will hereinafter be described more specifically by the following examples and comparative examples. Incidentally, all designations of "part" or "parts" and "%" as will be used in the following examples mean part or parts by weight and % by weight unless expressly noted.

EXAMPLES 1 to 9

(A) Production of Ink-jet Printing Cloth:

Using 100% silk crepe de Chine and 100% wool muslin, pretreatments using their corresponding pretreatment agents shown in Table 1 were conducted by the padding process. The thus-pretreated fabrics were then squeezed to a pickup of 90% by a mangle and dried at a drying temperature of 120° C. for 2 minutes.

(B) Preparation of Ink-jet Printing Inks:

Reactive dye inks were prepared in the following manner. The total amounts of the inks are all 100 parts.

| | |
|---|---|
| Reactive dye | 10 parts |
| Thiodiglycol | 40 parts |
| Water | 50 parts. |

Dyes used were C.I. Reactive Yellow 95, C.I. Reactive Red 226, C.I. Reactive Blue 15 and C.I. Reactive Black 39.

(C) Ink-jet Printing:

Using a Bubble Jet Printer BJC-820J (trade name, manufactured by Canon Inc.) as an ink-jet printing apparatus, the above-prepared printing inks were charged in this printer. The fabrics were separately mounted on base paper webs to permit the conveying of the fabrics, thereby printing the fabrics. Any printing apparatus may be used without limiting to the above printer.

(D) Post-treatment:

The printed fabrics were subjected to a steaming treatment at 100° C. for 8 minutes. The thus-treated cloths were washed and then dried.

(E) Evaluation of Prints:

The thus-obtained print samples and the fabrics used were evaluated in the following manner. The results thereof are shown collectively in Table 1.

(1) Bleeding:

The linearity of fine-line portions in each print sample was visually observed to rank resistance to bleeding in accordance with the following standard:

A: Good;

B: Somewhat poor;

C: Poor.

(2) Color depth (K/S) of print:

A minimum spectral reflectance of a 20×20 mm square printed portion in each print sample was measured by a Minolta Spectrocolorimeter CM-2022 (trade name). A K/S value was found from this reflectance. The color depth of each print sample was ranked in terms of this K/S value in accordance with the following standard:

A: Greater than 13;

B: 10 to 13;

C: Smaller than 10.

(3) Drying Property:

Printing was conducted by the BJC-820J printer, and the printed area was rubbed with a cloth upon elapsed time of 90 seconds after the printing. The drying property was evaluated by whether ink smearing occurred or not and ranked in accordance with the following standard:

A: No ink smearing occurred;

C: Ink smearing occurred.

(4) Strike-through Property:

A color depth on a back surface of a cloth was compared with that on a printed surface of the cloth visually to evaluate a strike-through property. The strike-through property was ranked in accordance with the following standard:

A: A color depth on the back surface is not so inferior to that on the printed surface;

B: A color depth on the back surface is somewhat inferior to that on the printed surface; and C: A color depth on the back surface is remarkably inferior to that on the printed surface.

Comparative Examples 1 and 2:

Ink-jet printing and evaluation were conducted in the same manner as in Example 1 except that their corresponding pretreatment agents shown in Table 1 were used. The results thereof are shown collectively in Table 1.

TABLE 1

| | Cloth | Pretreatment agent Treatment agent/Concentration of aqueous solution (%) | Bleeding | Color depth | Drying property | Strike-through property |
|---|---|---|---|---|---|---|
| Ex. 1 | Silk | Water-soluble polymer 1/1, $Na_2SO_4$/2, NaCl/3, $NaHCO_3$/2 | A | A | A | A |
| Ex. 2 | Silk | $Na_2SO_4$/2, NaCl/3, $NaHCO_3$/2 | A | A | A | A |
| Ex. 3 | Silk | Water-soluble polymer 2/1, $Na_2SO_4$/1, NaCl/3, $NaHCO_3$/2 | A | A | A | A |
| Ex. 4 | Silk | Water-soluble polymer 1/1, $Na_2SO_4$/2, $CH_3COONa$/1, $NaHCO_3$/2 | A | A | A | A |
| Ex. 5 | Silk | Water-soluble polymer 1/1, $Na_2SO_4$/2, NaCl/2, $NaHCO_3$/2, Surfactant 1/1 | A | A | A | A |
| Ex. 6 | Silk | Sodium citrate/1, NaCl/2, $NaHCO_3$/3, Surfactant 1/1 | A | A | A | A |
| Ex. 7 | Silk | $Na_2SO_4$/3, NaCl/2, $NaHCO_3$/2, Surfactant 1/1 | A | A | A | A |
| Ex. 8 | Silk | $Na_2SO_4$/2, NaCl/2, $NaHCO_3$/3, Surfactant 1/2 | A | A | A | A |
| Ex. 9 | Wool | $Na_2SO_4$/2, NaCl/2 | A | A | A | A |
| Comp. Ex. 1 | Silk | $Na_2SO_4$/5, $NaHCO_3$/2 | C | C | A | C |
| Comp. Ex. 2 | Silk | NaCl/5, $NaHCO_3$/2 | B | B | C | B |

Notes:
Water-soluble polymer 1: Alkox E60 (trade name)/polyethylene oxide, molecular weight: 1,100,000 (product of Meisei Chemical Works, Ltd.).
Water-soluble polymer 2: Alkox E75 (trade name)/polyethylene oxide, molecular weight: 2,200,000 (product of Meisei Chemical Works, Ltd.).
Surfactant 1: BL 4.2/nonionic surfactant (product of Nikko Chemicals Co., Ltd.).

Since the ink-jet printing cloths according to the present invention have been constituted in the above-described manner, ink bleeding on the cloths when inks are applied to the cloths can be surely prevented. Therefore, the amount of the inks to be applied to the cloths can be increased.

Besides, the ink-jet printing cloths according to the present invention can increase the amount of inks penetrating in the interiors of the cloths (good in tendency to strike-through). Therefore, bleeding is prevented even if a great amount of inks is applied to the cloths. As a result, deep textile printing can be performed with high color depth, and moreover high-quality prints with little difference in coloring between both sides can be provided.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printing cloth comprising at least two water-soluble neutral salts incorporated thereinto, in a proportion of 0.1 to 30% by weight based on the cloth, and polyethylene oxide having a weight average molecular weight ranging from 100,000 to 4,000,000 incorporated thereinto, in a proportion of 0.1 to 30% by weight based on the cloth, wherein said two salts are composed of a salt A in which its anion has a salting-out ability greater than that of an acetate ion and a salt B in which its anion has a salting-out ability equal to or smaller than that of the acetate ion.

2. The ink-jet printing cloth according to claim 1, wherein the weight ratio of the salt A to the salt B satisfies the relationship:

$$0.2<(\text{content of salt A}/\text{content of salt B})<5.$$

3. The ink-jet printing cloth according to claim 2, wherein the weight ratio of the salt A to the salt B satisfies the relationship:

$$0.3<(\text{content of salt A}/\text{content of salt B})<3.$$

4. The ink-jet printing cloth according to claim 1, wherein the cation of each of the salts is a sodium ion.

5. The ink-jet printing cloth according to claim 1, wherein the salt A is sodium sulfate, and the salt B is sodium chloride.

6. The ink-jet printing cloth according to claim 1, wherein the polyethylene oxide is contained in a proportion of from 0.2 to 5% by weight based on the cloth.

7. The ink-jet printing cloth according to claim 1, wherein the polyethylene oxide has a weight average molecular weight ranging from 500,000 to 2,500,000.

8. The ink-jet printing cloth according to claim 1, which further comprises an alkaline substance in a proportion of from 0.1 to 10% by weight based on the cloth.

9. The ink-jet printing cloth according to claim 8, which further comprises an alkaline substance in a proportion of from 0.5 to 5% by weight based on the cloth.

10. An ink-jet printing process comprising ejecting inks from an ink-jet printing apparatus to print a cloth, wherein the cloth according to any one of claims 1 to 9 is used as said cloth.

11. The ink-jet printing process according to claim 10, wherein thermal energy is applied to the inks to eject the inks.

12. The ink-jet printing process according to claim 10, wherein the inks contain a reactive dye, and the cloth is formed of silk.

13. A print produced in accordance with the ink-jet printing process according to claim 10.

* * * * *

UNITED STATES PATENT AND TRADEMARK OFFICE

CERTIFICATE OF CORRECTION

PATENT NO. : 6,203,888 B1
DATED : March 20, 2001
INVENTOR(S) : Makoto Aoki

It is certified that error appears in the above-identified patent and that said Letters Patent is hereby corrected as shown below:

Column 4,
Line 30, "view point" should read -- viewpoint --.

Column 6,
Line 17, "is" should read -- are --.

Column 9,
Line 31, "internal" should read -- internal pressure --.
Line 32, "pressure" should be deleted.
Line 52, "macro processing" should read -- macro-processing --.

Signed and Sealed this

Fourth Day of December, 2001

*Attest:*

Nicholas P. Godici

*Attesting Officer*

NICHOLAS P. GODICI
*Acting Director of the United States Patent and Trademark Office*